US005938113A

United States Patent [19]

Kim

[11] Patent Number: 5,938,113

[45] Date of Patent: Aug. 17, 1999

[54] MAILBOX WITH MAIL STORAGE AND THEFT PREVENTION

[76] Inventor: Duk M. Kim, 5 Woodland Cir., Manalapan, N.J. 07726

[21] Appl. No.: 09/056,771

[22] Filed: Apr. 8, 1998

[51] Int. Cl.[6] ..... B65G 11/04

[52] U.S. Cl. ..... 232/47; 232/17; 232/43.1; 232/45

[58] Field of Search ..... 232/17, 45, 43.1, 232/47

[56] References Cited

U.S. PATENT DOCUMENTS

| | | | |
|---|---|---|---|
| 3,735,919 | 5/1973 | Morgan | 232/17 |
| 3,802,619 | 4/1974 | Vanderveer | 232/17 X |
| 3,880,344 | 4/1975 | Earle | 232/17 |
| 4,724,999 | 2/1988 | Fitzgerald et al. . | |
| 4,844,332 | 7/1989 | Long | 232/17 |
| 4,993,626 | 2/1991 | Berry . | |
| 5,148,974 | 9/1992 | Clapper | 232/17 |
| 5,435,484 | 7/1995 | Carlson | 232/47 |
| 5,482,208 | 1/1996 | Johnston | 232/47 |
| 5,526,979 | 6/1996 | Mann . | |

*Primary Examiner*—Brian K. Green
*Assistant Examiner*—William L. Miller
*Attorney, Agent, or Firm*—Frishauf, Holtz, Goodman, Langer & Chick

[57] ABSTRACT

A mailbox includes a housing for receiving and storing mail, the housing having a first upper opening through which mail can be deposited and retrieved, and a second lower opening through which mail can be retrieved; a mailbox door mounted to the housing for movement between a first door position in covering relation to the first opening and a second door position out of the covering relation; and a lockable door movable between a first locked position in covering relation to the second opening and a second unlocked position out of the covering relation to permit access to the housing. A mail support is movably mounted within the housing for movement between a first mail support position for supporting mail adjacent the first opening and a second position for supplying mail to a lower portion of the housing adjacent the second opening. A lower support is movably mounted within the housing for movement between a first support position to prevent the mail support from moving to the second position, in response to movement of the mailbox door to the second door position, and a second position out of engagement with the mail support so as to release the mail support so that the mail support can move to the second position thereof, in response to movement of the mailbox door to the first door position. A support member is provided for releasably retaining the mail support in the first mail support position, regardless of the position of the mailbox door and the lower support.

23 Claims, 5 Drawing Sheets

MAILBOX WITH MAIL STORAGE AND THEFT PREVENTION

BACKGROUND OF THE INVENTION

This invention relates generally to a secure mailbox with mail storage and a theft prevention device which prevents thefts of articles received in the mailbox.

The mailbox of the present invention allows a mail carrier to deliver mail or to pickup mail in the normal manner. The mailbox of the present invention also allows accepting and storing mails in a secure, theft-proof manner, and allows easy retrieval of delivered mails at a later date instead of making a trip to the post office. The mailbox of the present invention further allows to eliminate time consuming trips to a post office for requesting to hold mails at the post office during vacation or business trips or for any other short or long period of time. In addition, the mailbox of the present invention also allows regular mail delivery, mail pickup and retrieval without interfering with stored mails. The mailbox of the present invention provides a safe deposit of delivered mail to be retrieved at a later date.

Conventionally, a mailbox erected at the edge of a roadway or curb side of a street in a rural area, town and village is used primarily for temporarily holding or storing delivered mail for a short duration, for example, for a few hours or a day or several days, without providing safeguards against theft of the delivered mail.

Many users of mailboxes in rural areas, towns and villages would prefer to have their valuable mail stored in a safe manner and without interruption of daily mail delivery, while having the flexibility of storing mail for a long period of time while they are away and allowing them to retrieve stored mail at a later date when they return.

Several known mailboxes have sought to safeguard delivered mail by providing locks and slots for retrieval, but have generally failed to provide sufficiently convenient, long term storage and retrieval capabilities. Such prior art mailboxes are disclosed in, for example, U.S. Pat. No. 4,724,999 to Fitzgerald et al; 4,993,626 to Berry; and 5,526,979 to Mann. The present invention is directed to improvements over these prior art devices.

In addition, the U.S. Post Office provides mailboxes at street corners which are capable of collecting mail which is to be picked up by post office personnel. However, such mailboxes, if used as mailboxes for individuals, do not provide a method of retrieving the delivered and held mail in the mailbox without accessing the storage compartment of the mailbox with keys, and do not provide a method of holding outgoing mail which is to be picked up by a mail carrier.

It is therefore desired to provide a secure mailbox with a device which is capable of accepting and holding mail and which provides for convenient retrieval of the mail by the mailbox owner on a daily basis and which also allows outgoing mail to be picked up by a mail carrier on a daily basis, without interfering with previously stored mail. In addition, it is desired to provide such a mailbox device which allows the continuous and secure storage of delivered mail. Still further, it is desired to provide such a mailbox device which provides secure mail storage for a long period of time, and convenient retrieval capabilities, without dependence on visiting a post office to recover mail which has been held in the post office.

SUMMARY OF THE INVENTION

Accordingly, it is an object of the invention to provide a mailbox which is capable of safely storing delivered mail and which later allows retrieval of the stored mail.

It is another object of the invention to provide a mailbox that provides flexibility of mail delivery and mail pick up of outgoing mail by a mail carrier and retrieval of mail by the owner on a daily basis and/or safely storing mail for an extended period of time and to be recovered by the owner at a later date.

It is still another object of the invention to provide a mailbox that eliminates time consuming and inconvenient trips to the post office to request or reclaim mail held thereby.

It is yet another object of the invention to provide a mailbox that reduces post office operating costs which are related to handling and holding mail in the post office and eliminating additional space requirement for storing such held mail.

In accordance with an aspect of the present invention, a mailbox includes a housing for receiving and storing mail, the housing having a first upper opening through which mail can be deposited and retrieved, and a second lower opening through which mail can be retrieved; a mailbox door mounted to the housing for movement between a first door position in covering relation to the first opening and a second door position out of the covering relation to the first opening; and a lockable door movable between a first locked position in covering relation to the second opening and a second unlocked position out of the covering relation to the second opening to permit access to the housing. A mail support is movably mounted within the housing for movement between a first mail support position for supporting mail thereon adjacent the first opening, and a second position for supplying mail to a lower portion of the housing adjacent the second opening. A lower support is movably mounted within the housing for movement between a first support position to prevent the mail support from moving to the second position, in response to movement of the mailbox door to the second door position, and a second position to release the mail support so that the mail support can move to the second position thereof in order to supply mail thereon to the lower portion of the housing adjacent the second opening, in response to movement of the mailbox door from the second door position to the first door position.

The mailbox door is pivotally mounted to the housing for movement between the first and second door positions; the mail support is pivotally mounted within and to the housing, and is movable between the first mail support position and the second position; and the lower support is pivotally mounted within and to the housing. Preferably, the mailbox door and the lower support are fixed relative to each other, and are both pivotally mounted to the housing along a common pivot axis, which is formed along a first pivot pin fixed to the housing. An extension member has one end fixed to the first pivot pin, and a second pivot pin fixed to an opposite end of the extension member, with the mail support being pivotally mounted on the second pivot pin.

Preferably, the mail support includes a flat mail support plate, and the lower support includes a flat lower support plate. In addition, the mail support plate includes a nub or projection at an underside thereof, and a free edge of the lower support plate engages the nub or projection when the lower support is moved to the first support position to support the mail support in the first mail support position.

In accordance with another aspect of the present invention, a mailbox includes a housing for receiving and storing mail, the housing having a first upper opening through which mail can be deposited and retrieved, and a second lower opening through which mail can be retrieved;

a mailbox door mounted to the housing for movement between a first door position in covering relation to the first opening and a second door position out of the covering relation to the first opening; and a lockable door movable between a first locked position in covering relation to the second opening and a second unlocked position out of the covering relation to the second opening to permit access to the housing. A mail support is movably mounted within the housing for movement between a first mail support position for supporting mail thereon adjacent the first opening, and a second position for supplying mail to a lower portion of the housing adjacent the second opening. A lower support is movably mounted within the housing for movement between a first support position to prevent the mail support from moving to the second position, in response to movement of the mailbox door to the second door position, and a second position to release the mail support so that the mail support can move to the second position thereof in order to supply mail thereon to the lower portion of the housing adjacent the second opening, in response to movement of the mailbox door from the second door position to the first door position; and a support member for releasably retaining the mail support in the first mail support position, regardless of the position of the mailbox door and the lower support.

Preferably, the support member includes an elongated rod in the housing, the elongated rod having an angled stub at an upper end thereof, and the elongated rod being movable between a rod support position for supporting the mail support in the first mail support position, and a rod release position for releasing the mail support to permit the mail support to move to the second position for supplying mail to the lower portion of the housing adjacent the second opening.

The elongated rod is preferably rotatably mounted in the housing between the rod support position and the rod release position, by means of guides mounted to the housing.

The elongated rod further includes a lower stub extending from the elongated rod, and there is a releasable latching arrangement which includes a first latch mounted in the housing for latching the lower stub to retain the rod in the rod release position and a second latch mounted in the housing for latching the lower stub to retain the rod in the rod support position.

The above and other objects, features and advantages of the invention will become readily apparent from the following detailed description thereof which is to be read in connection with the accompanying drawings.

DETAILED DESCRIPTION

Figure 1:
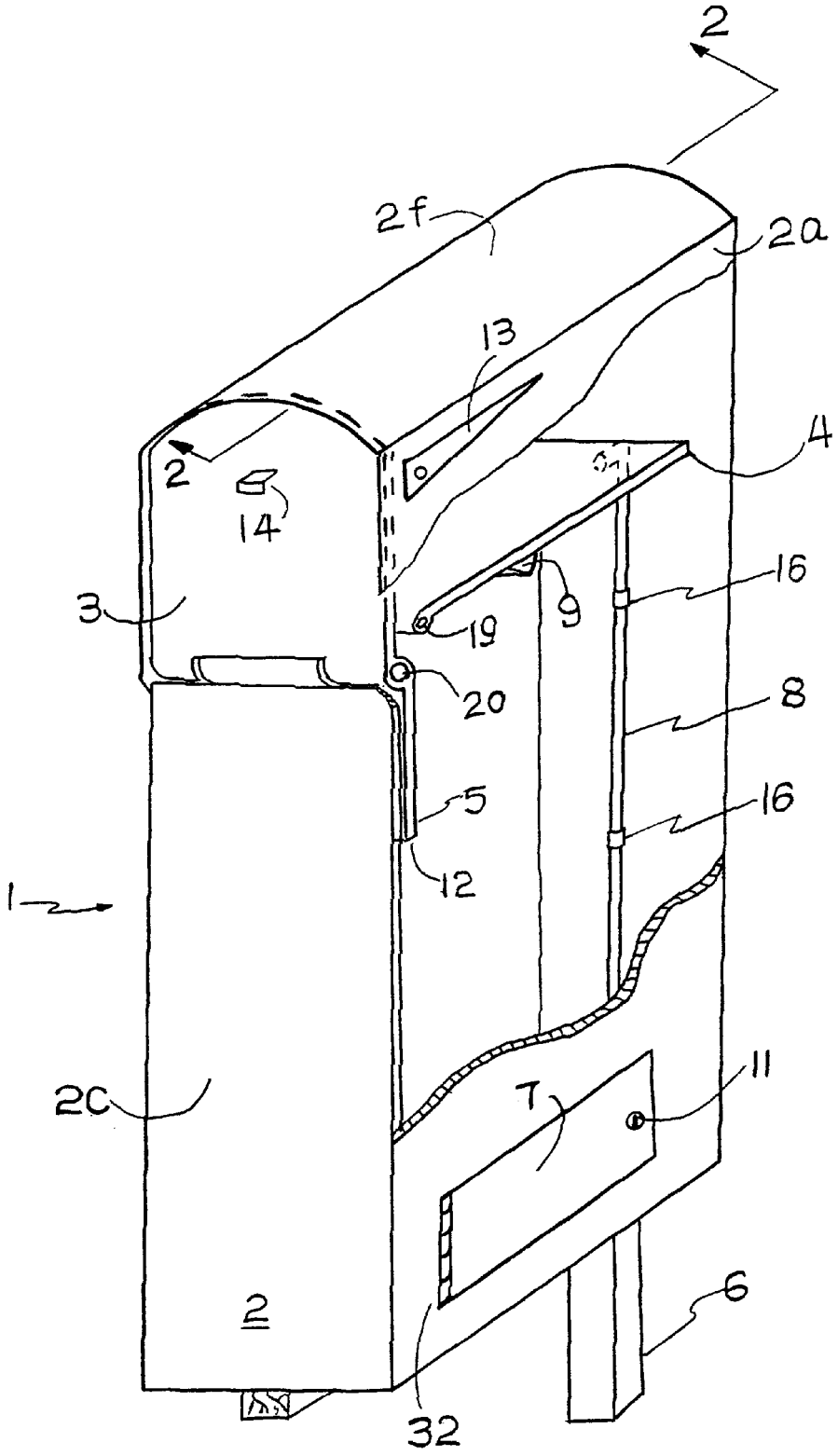
FIG. 1 is a perspective view of a mailbox according to the present invention.

Referring to the drawings in detail, a mailbox 1 with mail storage and retrieval capabilities in accordance with the present invention includes an elongated substantially rectangular parallelepiped shaped housing 2 defined by opposing wide side walls 2*a* and 2*b*, opposing front and rear narrow side walls 2*c* and 2*d* which connect together wide side walls 2*a* and 2*b*, a bottom wall 2*e* and a slightly arcuate top wall 2*f*. The size, shape, features and materials of housing 2 may vary, depending upon the desired storage capacity and intended location of mailbox 1. Housing 2 is preferably supported on a post 6 which is mounted in the ground.

Figure 2:
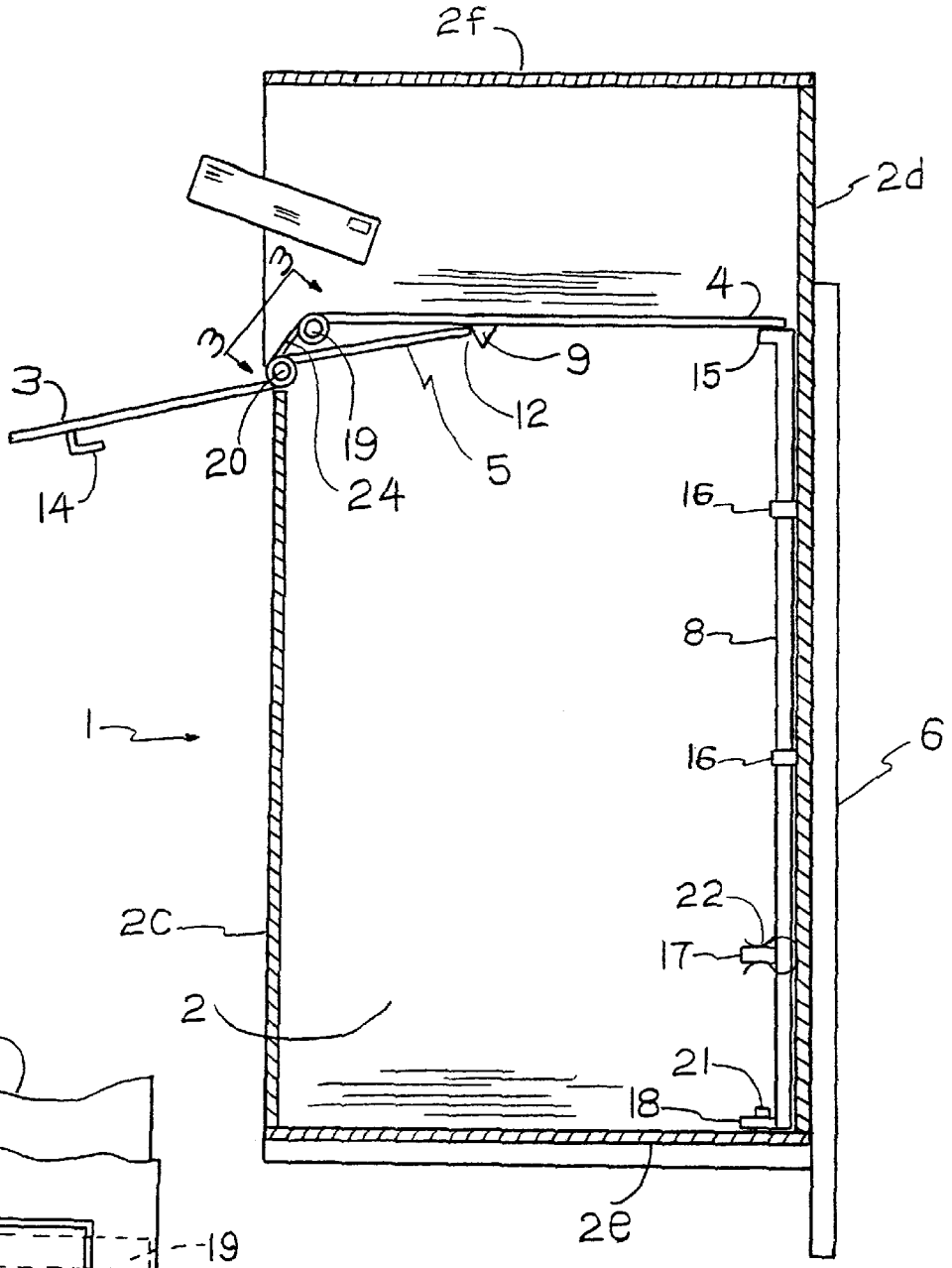
FIG. 2 is a cross-sectional view of the mailbox of FIG. 1, taken along line 2—2 thereof, and showing the mailbox door in an open position and the mailbox used as a conventional mailbox.

The upper end of front narrow side wall 2*c* has an upper opening therein, and a substantially rectangular metal mailbox door 3 is pivotally connected on a pivot pin 20 fixed to front narrow side wall 2*c* at the lower end of opening, for movement between the closed position shown in FIG. 1 (to close the opening) and the open position shown in FIG. 2. Mailbox door 3 preferably fits within the upper opening with a friction fit, as is conventional, although a latch (not shown) may be provided. In addition, mailbox door 3 includes a handle 14 that can be grasped for opening and closing mailbox door 3. Thus, mailbox door 3 can be opened to receive mail from mailbox 1 and to deposit mail therein.

A flag 13 is pivotally mounted to the upper exterior surface of wide side wall 2*a* to provide an indication by the mail carrier that mail has been deposited into mailbox 1.

Figure 3:
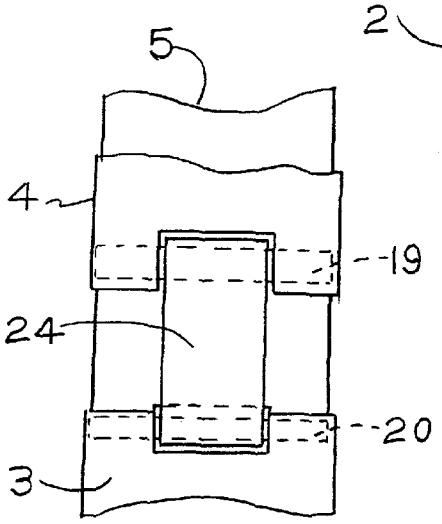
FIG. 3 is a plan view, taken along line 3—3 of FIG. 2, showing the pivot arrangements which connect the mailbox door, the mail support plate and the lower support plate.
Figure 4:
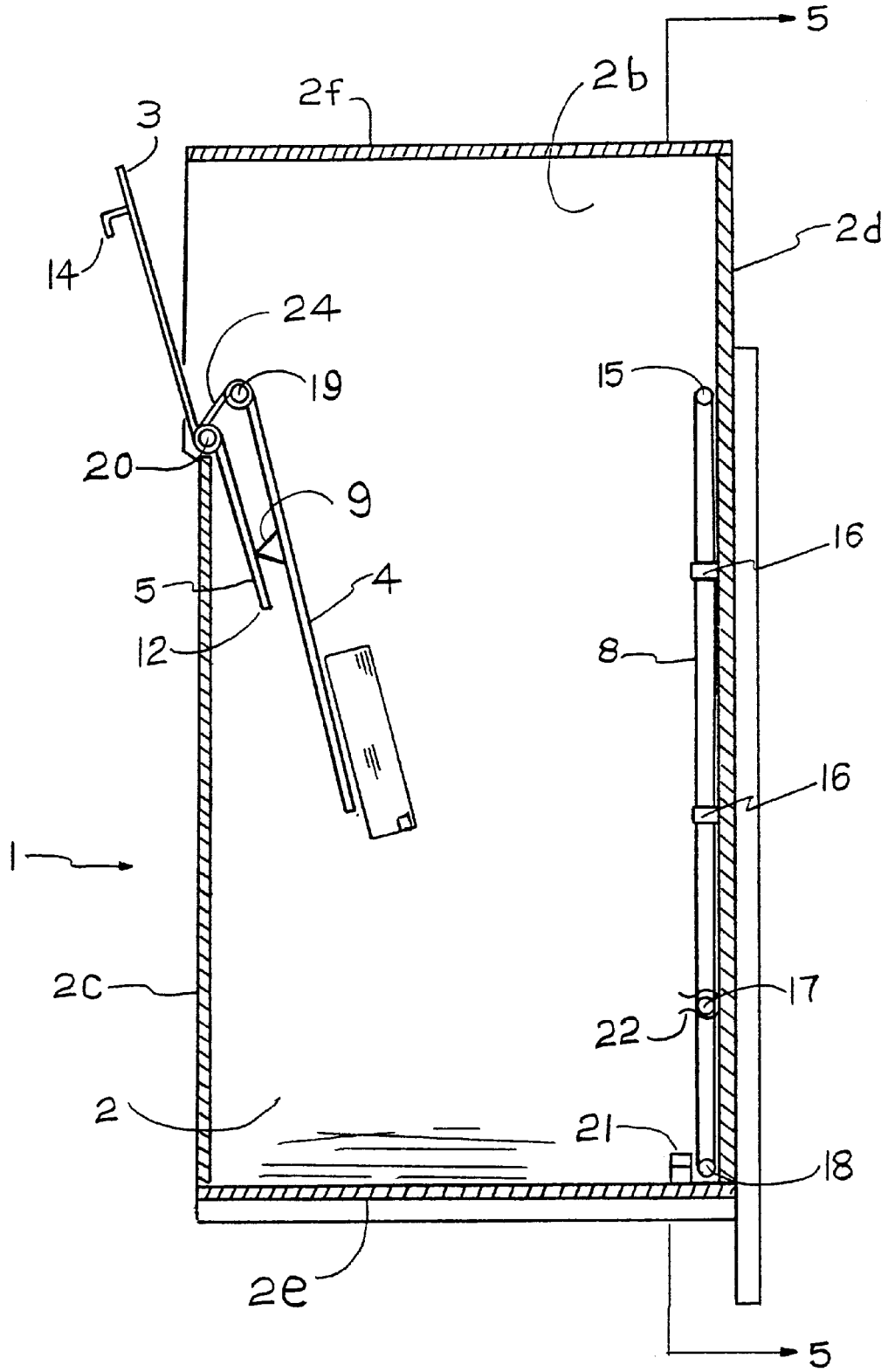
FIG. 4 is a cross-sectional view similar to FIG. 2, but showing the mailbox door in a mostly closed position and the mailbox used for long term mail storage and retrieval.
Figure 5:
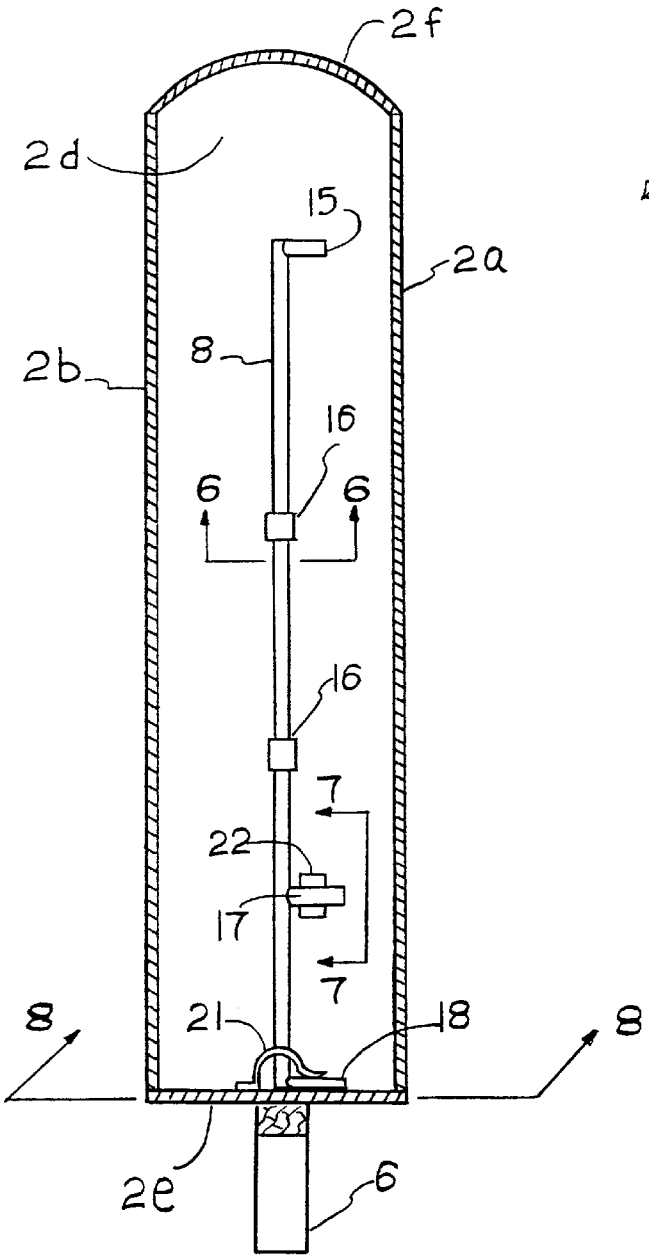
FIG. 5 is a cross-sectional view of the mailbox of FIG. 4, taken along line 5—5 thereof.
Figure 6:
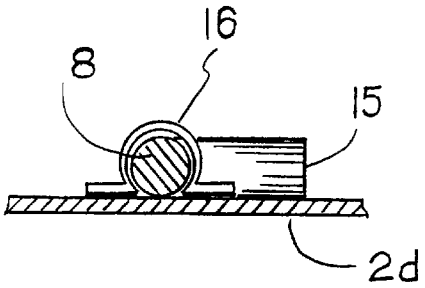
FIG. 6 is a cross-sectional view of a portion of the mailbox of FIG. 5, showing the mounting of the rod.
Figure 7:
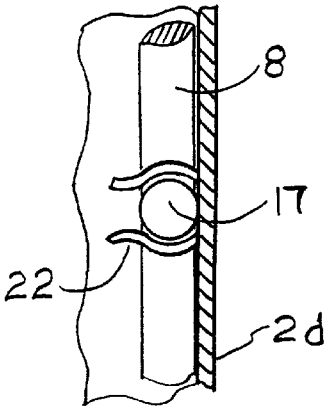
FIG. 7 is a cross-sectional view of a portion of the mailbox of FIG. 5, showing the handle on the rod secured by a latch.
Figure 8:
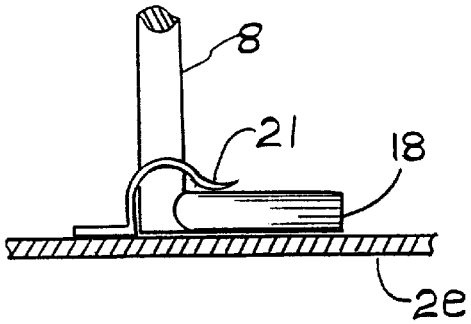
FIG. 8 is a cross-sectional view of a portion of the mailbox of FIG. 5, showing the lower stub of the rod moved away from the bottom plate latch.

A stationary extension plate 24 is fixed to pivot pin 20 so as to be immovable with respect thereto, while a pivot pin 19 is fixedly connected to the opposite end of stationary extension plate 24, as shown in FIGS. 2–4. Stationary extension plate 24 can also be fixed to front narrow side wall 2*c*.

A movable mail support plate 4 is pivotally mounted on pivot pin 19, to be pivoted between the support position of FIG. 2 and the non-support position of FIG. 4. Mail support plate 4 has a length slightly less than the width of wide side walls 2*a* and 2*b*, and a width slightly less than the width of narrow side walls 2*c* and 2*d*, so that when in the support position of FIG. 2, mail deposited through the upper opening will be held thereon. In this regard, mail support plate 4 is preferably in compliance with United States Post Office Postal Service standards, guides or regulations as to intended uses. A V-shaped thin metal nub 9, a rib or the like is attached to the underside of mail support plate 4.

A lower support plate 5 is integral with and forms an extension of mailbox door 3, and thereby is also pivoted on pivot pin 20 at the same location as mailbox door 3. Lower support plate 5 may have other shapes, sizes, and features than those shown, although it is desirable and preferable to make lower support plate 5 with a similar thickness and strength as the metal plate of mailbox door 3.

Thus, when mailbox door 3 is moved from the mostly closed position of FIG. 4 to the open position of FIG. 2, lower support plate 5 moves in the opposite direction, that is, from the lower position of FIG. 4 to the raised position of FIG. 2. Lower support platenubincludes a rim or free edge 12 which engages with nub 9 on mail support plate 4 when mailbox door 3 is in the open position of FIG. 2, to hold lower support plate 5 in a horizontal raised position to receive mail thereon. This provides the impression to the mail carrier that mailbox 1 is a conventional mailbox.

It will, however, be understood that a separate mailbox door 3, a separate lower support plate 5, and/or a separate mail support plate 4 may be provided to achieve the objects of the present invention. However, it is desirable and preferable to make lower support plate 5 integral with and as an extension of mailbox door 3, and to provide that mail support plate 4 is connected to pivoted hinge 19 via stationary extension plate 24 and pivot pin 20.

Elongated housing 2 also includes a lockable door 7 pivotally mounted by a hinge 32 at a lower portion of wide side wall 2*a* in covering relation to an opening in wide side wall 2*a*. Door 7 is provided with a key slot 11 for locking and unlocking door 7. In this manner, as will be understood from the explanation hereinafter, any mail that drops to the bottom of mailbox 1 can be retrieved.

A vertically oriented elongated rod 8 is provided with an inturned stub 15 at the upper end thereof, with stub 15 being perpendicular to the axis of rod 8, for supporting mail support plate 4, as shown in FIGS. 1 and 2, when mailbox 1 is used as a conventional mailbox. Upper stub 15 may be any shape, size, length or material, although it preferably includes the aforesaid features such that stub 15 can support mail support plate 4 when mailbox 1 is used as a conventional mailbox, and may be positioned to release mail support plate 4 to deliver mail into the bottom of mailbox 1.

Rod 8 is rotatably held against the inner surface of rear narrow side wall 2*d* by guides 16.

Alternatively, rod 8 can be rotated about its vertical axis to disengage inturned stub 15 from mail support plate 4, wherein mail support plate 4 pivots down by gravity, and any mail supported by mail support plate 4, is transferred into the bottom receptacle of mailbox 1. In this regard, a handle 17 is provided near the lower end of rod 8, and is perpendicular to the axis of rod 8, to be grasped by a user through the opening in wide side wall 2*a* when door 7 is opened. Thus, handle 17 can rotate rod 8 between the supporting position of FIG. 2 and the non-supporting position of FIG. 4. Handle 17 can be removably locked in position by a mechanical or magnetic latch 22 against side wall 2*d* to retain rod 8 so that inturned stub 15 is not supporting mail support plate 4, as shown in FIG. 4.

An inturned stub 18 is also provided at the lower end of rod 8, and is perpendicular to the axis of rod 8. Stub 18 is preferably parallel to stub 15. Another mechanical or magnetic latch 21 is provided on bottom wall 2*e* for removably locking stub 18 so that inturned stub 15 is supporting mail support plate, as shown in FIG. 2.

Although rod 8 is shown to be manually actuatable through lockable door 7, rod 8 may be mechanically and/or externally actuated. It is preferred, however, to actuate rod 8 manually through door 7 to prevent unauthorized tampering therewith.

To use mailbox 1 as a conventional mailbox, that is, during mail delivery on a daily basis, rod 8 is rotated 90° by means of handle 17, such that bottom stub 18 is secured in mechanical latch 21 and top stub 15 is positioned to support the underside of mail support plate 4. As a result, the only pivoting action upon opening mailbox door 3, is the pivoting movement of mailbox door 3 and lower support plate 5.

To use mailbox 1 as a long term mail storage device, rod 8 is rotated 90° to the position of FIG. 4 by means of handle 17 such that handle 17 is secured in mechanical latch 22 and top stub 15 is moved away from its support position, whereby top stub 15 no longer supports mail support plate 4. When mailbox door 3 is opened, lower support plate 5 supports and moves mail support plate 4 to the mail support position shown in FIG. 2. Therefore, a mail carrier believes that he or she is depositing mail into a conventional mail box. In this position, lower nub or projection 9 of mail support plate 4 is engaged by edge 12 of lower support plate 5. When nub or projection 9 of mail support plate 4 is engaged by edge 12 of lower support plate 5, the plane of mail support plate 4, the plane of lower support plate 5 and the common plane intersecting the pivot axes 19 and 20 of mail support plate 4 and lower support plate 5 preferably creates an obtuse triangle. It will be understood, however, that any other shape of triangle or plural sided polygonal shape may be provided. The nub or projection 9 may extend partially or completely along the width of the mail support plate 4.

When mailbox door 3 is closed to the position shown in FIGS. 1 and 4, that is, after the mail has been delivered thereinto and is supported by mail support plate 4, lower support plate 5 pivots downwardly about pivot pin 20. As a result, mail support plate 4 is no longer supported by lower support plate 5, and pivots downwardly by gravity about pivot pin 19, so that mail support thereby falls to the bottom receptacle of mailbox 1.

Thus, with the present invention, mailbox 1 can be used as a conventional mailbox by locking mail support plate 4 in its raised position by stub 15. However, when used as a longer storage facility, for example, during vacations and the like, mail support plate 4 is only raised when mailbox door 3 is opened, thereby providing the impression that mailbox 1 is a conventional mailbox. However, as soon as mailbox door 3 is closed, mail support plate 4 pivots downwardly by gravity to deposit the mail supported thereby, to the bottom of mailbox 1, to be retrieved at a later time. It will be appreciated that an unauthorized person has no access to the mail in the bottom of mailbox 1. This is because, when mailbox door 3 is opened, mail support plate 4 is in blocking relation to such access.

Although mailbox 1 has been depicted with reference to a particular arrangement of parts, components, features and the like, these are not intended to exhaust all possible arrangements and features and indeed many other modifications and variations will be available to those of skills in the art including but not limited to use of the system for aesthetic or other reasons.

Figure 9:
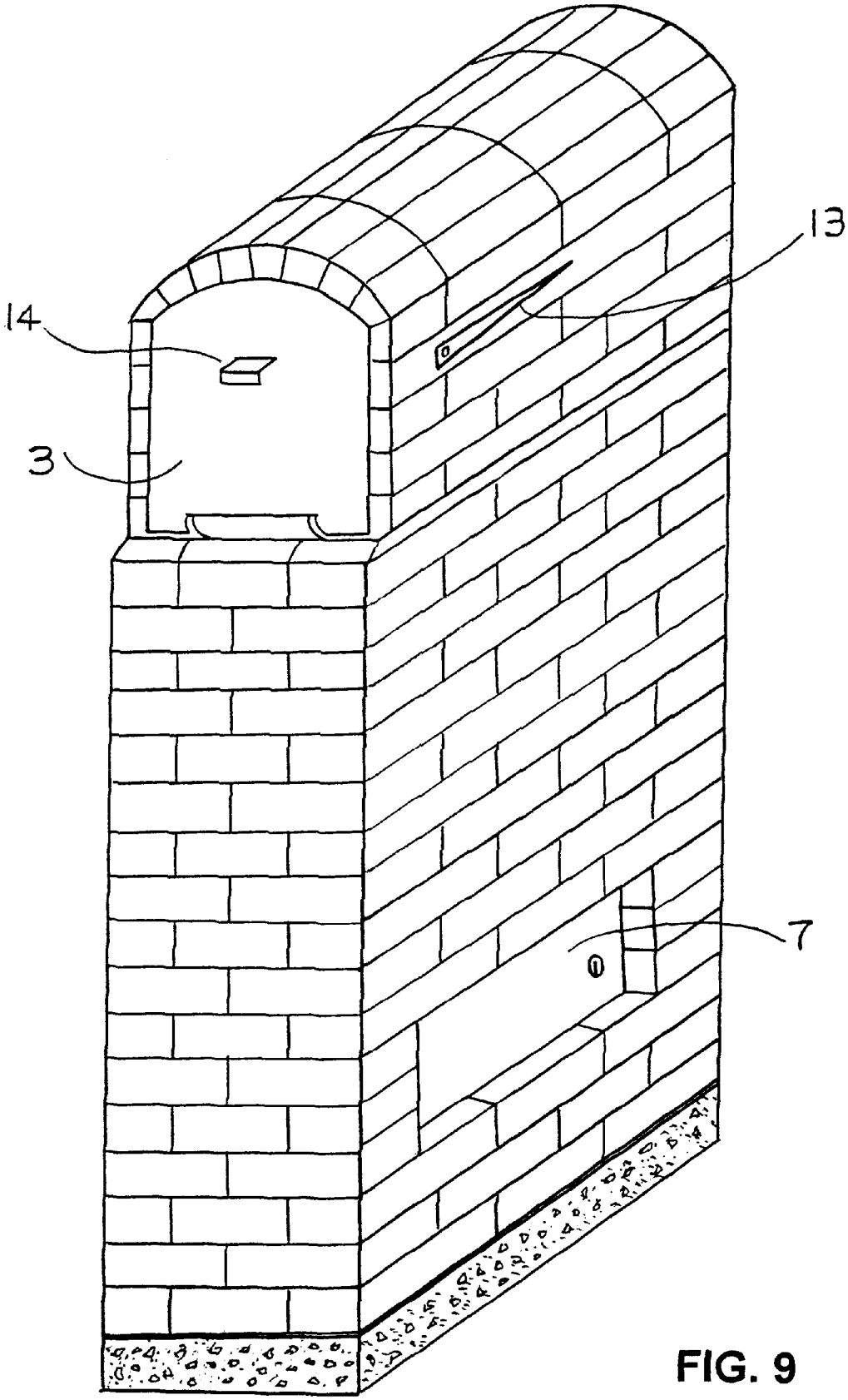
FIG. 9 is a perspective view of a mailbox according to another embodiment of the present invention, encapsulated by a brick structure.

For example, mailbox 1 may be a different size, shape or have different features. Further, mailbox 1 can be a stand alone device or can be included or encapsulated in a structure such as a brick enclosure, as shown in FIG. 9, for aesthetic or other reasons. It is, however, preferable to manufacture and install mailbox 1 as a complete assembly whether it is a stand alone device or housed or encapsulated within a structure.

It will be appreciated that, while mail support plate 4 has been shown to be mechanically held and released, mail support plate 4 may be mechanized to permit the aforesaid operations.

In addition, rod 8 can be eliminated, so that all mail falls to the bottom of mailbox 1 and must be retrieved through the opening covered by door 7.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A mailbox comprising:

a housing for receiving and storing mail, said housing having a first upper opening through which mail can be deposited and retrieved, and a second lower opening through which mail can be retrieved;

a mailbox door mounted to said housing for movement between a first door position in covering relation to said first opening and a second door position out of said covering relation to said first opening;

a lockable door movable between a first locked position in covering relation to said second opening and a second unlocked position out of said covering relation to said second opening to permit access to said housing;

a mail support movably mounted within said housing for movement between (i) a first mail support position for supporting mail thereon adjacent said first opening, and (ii) a second position for supplying mail to a lower portion of said housing adjacent said second opening; and a lower support movably mounted within said housing and connected to said mailbox door, said lower support being movable upon movement of said mailbox door between (i) a first support position to prevent said mail support from moving to said second position, in response to movement of said mailbox door to said second door position, and (ii) a second position out of engagement with said mail support so as to release said mail support so that said mail support can move to said second position thereof in order to supply mail thereon to the lower portion of said housing adjacent said second opening, in response to movement of said mailbox door from said second door position to said first door position.

2. A mailbox according to claim 1, wherein:

said mailbox door is pivotally mounted to said housing for movement between said first door position and said second door position;

said mail support is pivotally mounted within and to said housing for movement between said first mail support position and said second position; and said lower support is pivotally mounted within and to said housing for movement between said first and second positions thereof.

3. A mailbox according to claim 2, wherein said mailbox door and said lower support are fixed relative to each other, and are both pivotally mounted to said housing along a common pivot axis for common movement of said mailbox door and said lower support.

4. A mailbox according to claim 3, wherein said common pivot axis is formed along a first pivot pin fixed to said housing, and further including:

an extension member having one end fixed to said first pivot pin, and a second pivot pin fixed to an opposite end of said extension member, with said mail support being pivotally mounted on said second pivot pin.

5. A mailbox according to claim 1, wherein said mail support includes a mail support plate, and said lower support includes a lower support plate.

6. A mailbox according to claim 5, wherein said mail support plate includes a projection at an underside thereof, and a free edge of said lower support plate engages said projection when said lower support is moved to said first support position to support said mail support in said first mail support position and to prevent said mail support from moving to said second position of said mail support.

7. A mailbox according to claim 5, wherein:

said mailbox support plate is substantially flat; and said lower support plate is substantially flat.

8. A mailbox comprising:

a housing for receiving and storing mail, said housing having a first upper opening through which mail can be deposited and retrieved, and a second lower opening through which mail can be retrieved;

a mailbox door mounted to said housing for movement between a first door position in covering relation to said first opening and a second door position out of said covering relation to said first opening;

a lockable door mounted to said housing for movement between a first locked position in covering relation to said second opening and a second unlocked position out of said covering relation to said second opening to permit access to said housing;

a mail support movably mounted within said housing for movement between (i) a first mail support position for supporting mail thereon adjacent said first opening, and (ii) a second position for supplying mail to a lower portion of said housing adjacent said second opening;

a lower support movably mounted within said housing for movement between (i) a first support position to prevent said mail support from moving to said second position, in response to movement of said mailbox door to said second door position, and (ii) a second position out of engagement with said mail support so as to release said mail support so that said mail support can move to said second position thereof in order to supply mail thereon to the lower portion of said housing adjacent said second opening, in response to movement of said mailbox door from said second door position to said first door position; and a support member for releasably retaining said mail support in said first mail support position, regardless of the position of said mailbox door and said lower support.

9. A mailbox according to claim 8, wherein:

said mailbox door is pivotally mounted to said housing for movement between said first door position and said second door position;

said mail support is pivotally mounted within and to said housing for movement between said first mail support position and said second position; and said lower support is pivotally mounted within and to said housing for movement between said first and second positions thereof.

10. A mailbox according to claim 9, wherein said mailbox door and said lower support are fixed relative to each other, and are both pivotally mounted to said housing along a common pivot axis.

11. A mailbox according to claim 10, wherein said common pivot axis is formed along a first pivot pin fixed to said housing, and further including:

an extension member having one end fixed to said first pivot pin, and a second pivot pin fixed to an opposite end of said extension member, with said mail support being pivotally mounted on said second pivot pin.

12. A mailbox according to claim 8, wherein said mail support includes a mail support plate, and said lower support includes a lower support plate for common movement of said mailbox door and said lower support.

13. A mailbox according to claim 12, wherein said mail support plate includes a projection at an underside thereof, and a free edge of said lower support plate engages said projection when said lower support is moved to said first support position to support said mail support in said first mail support position and to prevent said mail support from moving to said second positions of said mail support.

14. A mailbox according to claim 12 wherein:

said mailbox support plate is substantially flat; and said lower support plate is substantially flat.

15. A mailbox according to claim 8, wherein said support member includes an elongated rod in said housing, said elongated rod having an angled stub at an upper end thereof, and said elongated rod being movable between a rod support position for supporting said mail support in said first mail support position, and a rod release position for releasing said mail support to permit the mail support to move to said second position for supplying mail to the lower portion of said housing adjacent said second opening.

16. A mailbox according to claim 15, wherein said elongated rod is rotatably mounted in said housing between said rod support position and said rod release position.

17. A mailbox according to claim 16, wherein said elongated rod further includes at least one extension, and further comprising a releasable latching arrangement for latching said at least one extension to retain said rod in at least one of said rod support position and said rod release position.

18. A mailbox according to claim 17, wherein:

said at least one extension includes a lower stub extending from said rod; and said releasable latching arrangement includes:

a first latch mounted in said housing for latching said lower stub to retain said rod in said rod release position; and a second latch mounted in said housing for latching said lower stub to retain said rod in said rod support position.

19. A mailbox according to claim 15, further comprising guides mounted to said housing for rotatably mounting said elongated rod in said housing.

20. A mailbox comprising:

a housing for receiving and storing mail, said housing having a first upper opening through which mail can be deposited and retrieved, and a second lower opening through which mail can be retrieved;

a mailbox door pivotally mounted to said housing for movement between a first door position in covering relation to said first opening and a second door position out of said covering relation to said first opening;

a lockable door movable between a first locked position in covering relation to said second opening and a second unlocked position out of said covering relation to said second opening to permit access to said housing;

a mail support movably mounted within said housing for movement between (i) a first mail support position for supporting mail thereon adjacent said first opening, and (ii) a second position for supplying mail to a lower portion of said housing adjacent said second opening; and a lower support movably mounted within said housing for movement between (i) a first support position to prevent said mail support from moving to said second position, in response to movement of said mailbox door to said second door position, and (ii) a second position out of engagement with said mail support so as to release said mail support so that said mail support can move to said second position thereof in order to supply mail thereon to the lower portion of said housing adjacent said second opening, in response to movement of said mailbox door from said second door position to said first door position;

wherein said mail support is pivotally mounted within and to said housing for movement between said first mail support position and said second position;

wherein said lower support is pivotally mounted within and to said housing for movement between said first support position and said second position thereof; and wherein said mailbox door and said lower support are fixed relative to each other, and are both pivotally mounted to said housing along a common pivot axis for common movement of said mailbox door and said lower support.

21. A mailbox according to claim 20, wherein said common pivot axis is formed along a first pivot pin fixed to said housing, and further including:

an extension member having one end fixed to said first pivot pin, and a second pivot pin fixed to an opposite end of said extension member, with said mail support being pivotally mounted on said second pivot pin.

22. A mailbox comprising:

a housing for receiving and storing mail, said housing having a first upper opening through which mail can be deposited and retrieved, and a second lower opening through which mail can be retrieved;

a mailbox door mounted to said housing for movement between a first door position in covering relation to said first opening and a second door position out of said covering relation to said first opening;

a lockable door movable between a first locked position in covering relation to said second opening and a second unlocked position out of said covering relation to said second opening to permit access to said housing;

a mail support movably mounted within said housing for movement between (i) a first mail support position for supporting mail thereon adjacent said first opening, and (ii) a second position for supplying mail to a lower portion of said housing adjacent said second opening; and a lower support movably mounted within said housing for movement between (i) a first support position to prevent said mail support from moving to said second position, in response to movement of said mailbox door to said second door position, and (ii) a second position out of engagement with said mail support so as to release said mail support so that said mail support can move to said second position thereof in order to supply mail thereon to the lower portion of said housing adjacent said second opening, in response to movement of said mailbox door from said second door position to said first door position;

wherein said mail support includes a mail support plate, and said lower support includes a lower support plate; and wherein said mail support plate includes a projection at an underside thereof, and a free edge of said lower support plate engages said projection when said lower support is moved to said first support position to support said mail support in said first mail support position and to prevent said mail support from moving to said second position of said mail support.

23. A mailbox according to claim 22, wherein:

said mailbox support plate is substantially flat; and said lower support plate is substantially flat.

* * * * *

UNITED STATES PATENT AND TRADEMARK OFFICE

CERTIFICATE OF CORRECTION

PATENT NO. : 5,938,113
DATED : August I7, 1999
INVENTOR(S) : Duk M. KIM

It is certified that error appears in the above-identified patent and that said Letters Patent is hereby corrected as shown below:

Column 5, line 3, change "platenubincludes" to --plate 5 includes--.

Signed and Sealed this
Twenty-fifth Day of July, 2000

*Attest:*

*Attesting Officer*

Q. TODD DICKINSON

*Director of Patents and Trademarks*